US012012817B2

(12) United States Patent
McCool

(10) Patent No.: US 12,012,817 B2
(45) Date of Patent: Jun. 18, 2024

(54) SUBTERRANEAN WELL PIPE AND CASING CUTTER WATER JET SYSTEM

(71) Applicant: Sean McCool, Montgomery, TX (US)

(72) Inventor: Sean McCool, Montgomery, TX (US)

(73) Assignee: Sean McCool, Montgomery, TX (US)

( * ) Notice: Subject to any disclaimer, the term of this patent is extended or adjusted under 35 U.S.C. 154(b) by 0 days.

(21) Appl. No.: 17/512,443

(22) Filed: Oct. 27, 2021

(65) Prior Publication Data

US 2022/0127921 A1 Apr. 28, 2022

Related U.S. Application Data

(60) Provisional application No. 63/198,558, filed on Oct. 27, 2020.

(51) Int. Cl.
*E21B 29/00* (2006.01)

(52) U.S. Cl.
CPC ..... *E21B 29/002* (2013.01)

(58) Field of Classification Search
CPC ..... E21B 29/00; E21B 29/002; E21B 29/02
See application file for complete search history.

(56) References Cited

U.S. PATENT DOCUMENTS 5,381,631 A * 1/1995 Raghavan ..... B24C 5/04 451/36
10,844,681 B2 11/2020 Nester et al.
2004/0089450 A1* 5/2004 Slade ..... E21B 41/0078 166/55.7
2007/0151731 A1* 7/2007 Butler ..... E21B 43/11 166/308.1
2013/0153227 A1* 6/2013 Laird ..... E21B 31/00 166/305.1
2015/0075793 A1* 3/2015 Dotson ..... E21B 47/06 166/99
2016/0084241 A1* 3/2016 Sato ..... F04B 1/295 417/222.1
2018/0021922 A1* 1/2018 Linde ..... B24C 1/045 451/2

* cited by examiner

*Primary Examiner* — Christopher J Sebesta
(74) *Attorney, Agent, or Firm* — Ramey LLP; Jacob B. Henry

(57) ABSTRACT

The present disclosure relates to water jet cutter tools for subterranean oil and gas well pipe and tubular cutting. The present disclosure relates to an assembly including the water jet cutting tools. The present disclosure relates to methods of cutting subterranean oil and gas well pipe and tubulars using water jet cutting tools.

9 Claims, 4 Drawing Sheets

SUBTERRANEAN WELL PIPE AND CASING CUTTER WATER JET SYSTEM

RELATED APPLICATIONS

This application claims priority to U.S. Provisional Patent Application 63/198,558 filed on Oct. 27, 2020 which is specifically incorporated by reference in its entirety herein.

BACKGROUND OF THE INVENTION

1. Technical Field

The present disclosure relates to subterranean wells and reservoirs in general, and to systems and methods for cutting and severing the casing and pipework within the well.

2. Background Information

During multiple stages of the creation and/or operation of a subterranean well, there is the possibility and requirement to cut the well wall (tubing or casing) and sever the casing. In most instances these tools require to be lowered into the well via drill pipe or tubular.

Various types of cutting tools may be lowered into the subterranean well to perform this function. The most common methods of achieving this operation are:

Mechanical cutting. This involves using mechanical force to cut through the casing and work its way round the casing until the casing is parted. This uses a cutting wheel and takes approx. 100 rotations. This is driven by drill pipe or tubular from surface. A good example of this would be a can opener, a disc presses against the casing and gradually cuts through. This process can take up to 12 hours depending on size and thickness of the casing. Another mechanical method uses a cutting bit with multiple carbide teeth which gradually expand from the tool via mechanical action or hydraulic pressure and cut through the casing via rotation of the drill pipe from surface. This process creates heat, shavings or chippings and again, can take many hours to perform.

Chemical Erosion. A corrosive fluid is introduced into the area to be cut. This reaction eroded the casing wall and eventually severs the wall. The corrosive fluid is then required to be flushed or diluted from the well to prevent further unintentional material loss.

Explosive cutter. The deployment of this method differs from the above, due to the fact it can be lowered into the well via wireline. Once on depth, a ring of shaped explosive charges or cord are fired parting the well. While effective at cutting, the remaining casing is usually very rough and uneven. The logistics of explosives and detonators make this method high risk and high cost for many applications.

SUMMARY OF THE INVENTION

The present disclosure relates generally to a cutting tool for cutting a tubular. Preferably, cutting tools of the present disclosure include a top connection and electronics section for containing the controls and measurement technology to allow the tool to be operated and monitored from the surface using software. Preferably, cutting tools of the present disclosure include one or more fluid containment sections containing fluid for use by the cutter. Preferably, cutting tools of the present disclosure include a pump section for compressing the fluid to a specified pressure. Preferably, cutting tools of the present disclosure include an accumulator section to facilitate the use of a continuous pressure while running with no drops or interruptions. Preferably, cutting tools of the present disclosure include a clamping section with hydraulically actuated arms extending from the tool body and clamping against the casing wall. Preferably, cutting tools of the present disclosure include a rotary section to allow the lower section to rotate. Preferably, cutting tools of the present disclosure include a cutting section to house the cutting media and a cutting fluid mixture to cut the casing as the section rotates, severing the pipework. Preferably, cutting tools of the present disclosure include a lower centralizer to centralize the cutting section. These embodiments are exemplary and the present disclosure is not so limited.

DETAILED DESCRIPTION

The present casing cutter water jet systems preferably feature one or more of the following: The tool system is preferably lowered into the well using e-line wireline. Those of skill in this art will understand that coiled tubing and other tools may be used to lower the tool system instead of a wireline. Preferably, the tool is self-contained system, with only command control being on surface. As such, preferably there is no need for multiple runs or additional surface equipment. Hence, it is preferable that the water jet cutter system is contained in a series of stackable sections which can be added or subtracted from, depending on the casing dimensions, cut depth, and other parameters.

Preferred embodiments contain fluids within the system are that are environmentally friendly. A preferred embodiment is fresh water and an additional bio-friendly lubricity agent. Preferably, the fluid functions to cut the casing, cool and lubricate the pumps and motors, and accts as a hydraulic media to pressure and engage the clamps. Preferably, there is no conventional hydraulic fluid in the cutting sections.

Preferred embodiments use a self-contained, high pressure jet cutting system to sever the casing. Preferably there are two or more pumps—one a high pressure pump to create the pressure for the cut and a secondary pump to create a lower pressure to engage the clamps. Preferred embodiments include one or more accumulators to keep a storage of the fluid. Preferably, the rotary section allows control and programing of the cutting revolution.

Preferred embodiments are made of several sections, of which multiples can be used in key areas to allow a large range of casing to be cut.

Figure 1:
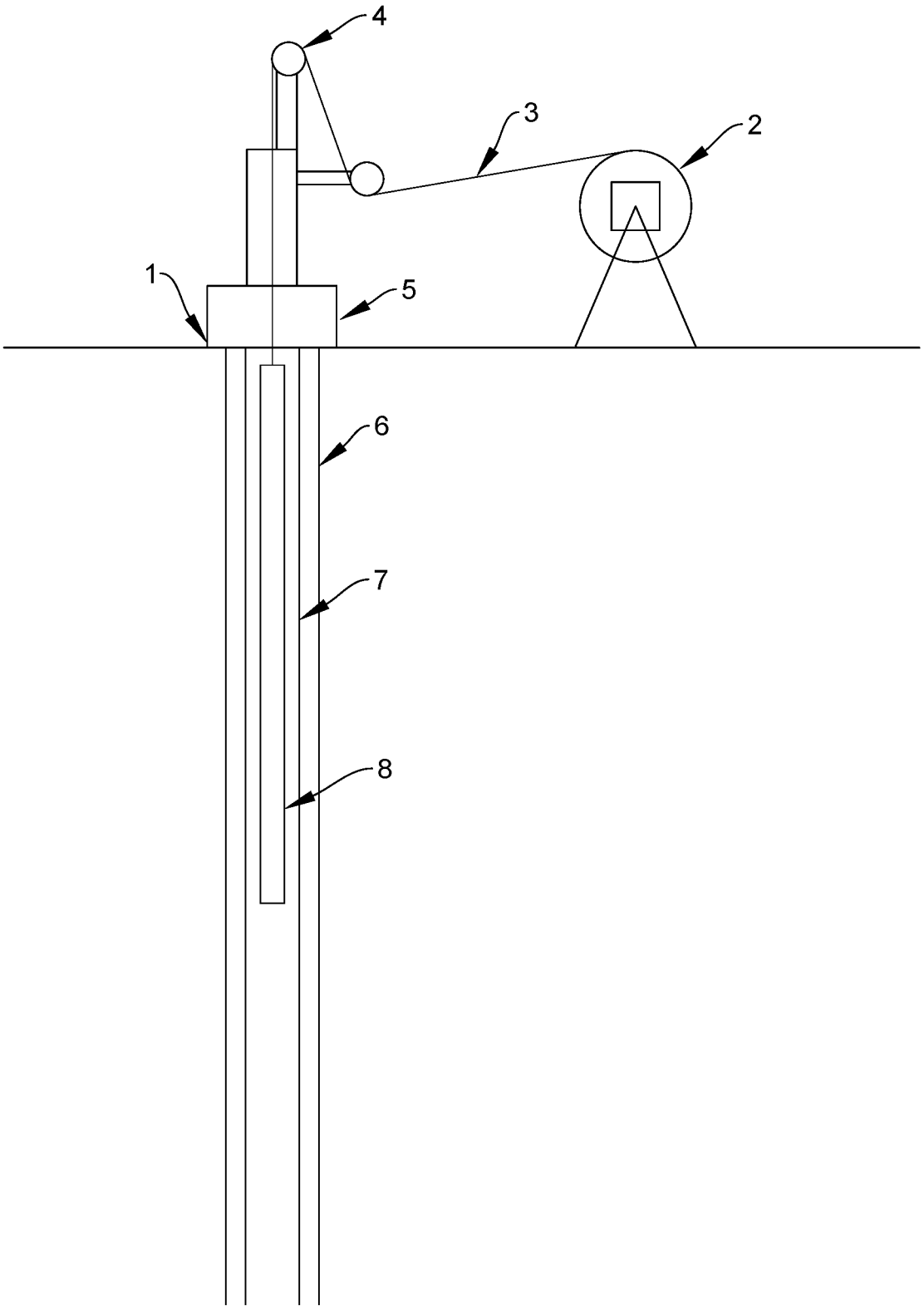
FIG. 1 is a diagrammatic illustration of a subterranean well with a present disclosure system.

Referring to FIG. 1, this shows an example of the use of a preferable non limiting embodiment. In this preferred embodiment, a subterranean well 1 is diagrammatically shown having a casing lined wellbore 7 that extends into a subterranean formation 6. The subterranean well 1 is shown as a land-based well, but the present disclosure is not limited thereto. The well 1 includes a well casing 7 and a wellhead control package 5. The water jet cutter tool 8 is shown disposed within the wellbore 7 at a distance from the wellhead 4. The water jet cutter is suspended on e-line 3 from the wireline unit 2 over the top sheave 4. The subterranean well 1 diagrammatically shown is a vertical well, the present disclosure is not limited to vertically disposed wells or deviated wells, and in those instances where the well is deviated, the well is not limited to any particular geometry.

Figure 2:
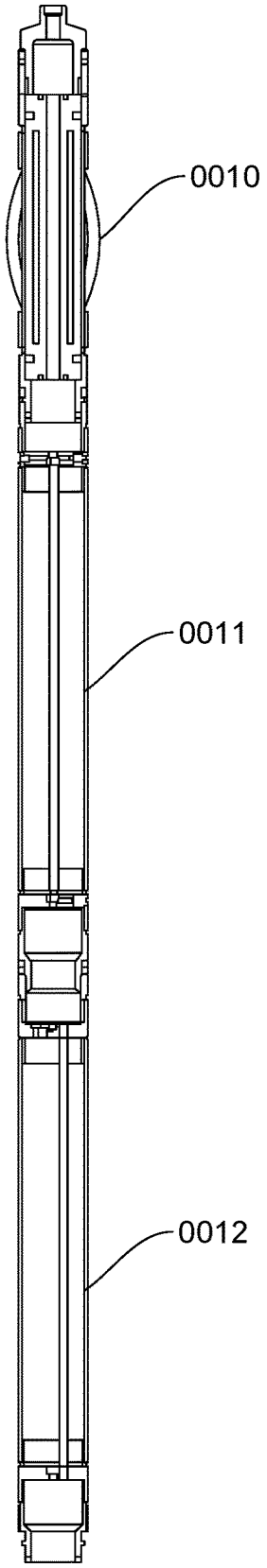
FIG. 2 is a diagrammatic illustration of an example of the top portion of a water jet cutter of the present disclosure.
Figure 3:
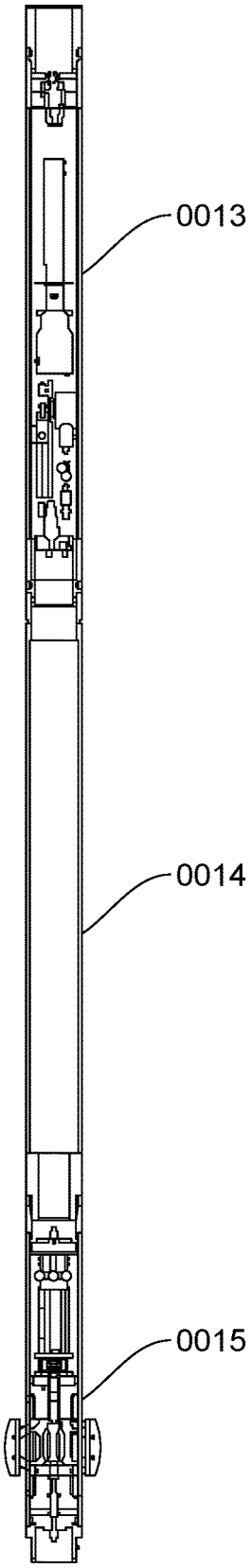
FIG. 3 is a diagrammatic illustration of an example of the middle portion of a water jet cutter of the present disclosure.
Figure 4:
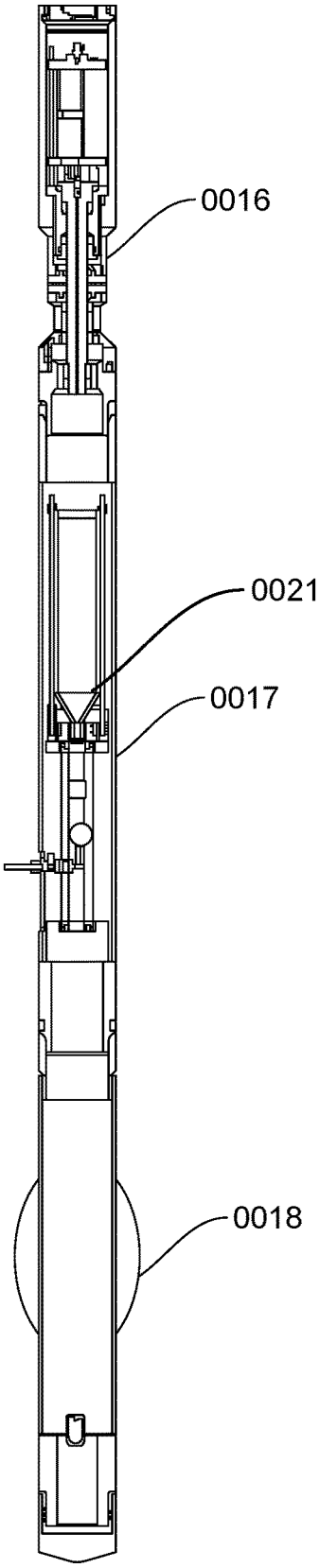
FIG. 4 is a diagrammatic illustration of an example of the middle portion of a water jet cutter of the present disclosure.

Referring to FIGS. 2, 3, and 4, working from the top of the system down, the sections are as follows:

The top comprises top connection and electronics section 10 including go pin connection for e-line attachment. The electronics housing preferably contains the controls and measurement technology to allow the tool to be operated and monitored from surface using dedicated software. In this embodiment, power is preferably supplied to the tool using a 1500 KW Power supply which is located within the wireline unit.

Next are the fluid containment section(s) 11 and 12. These are large pressure resistant sections, each preferably containing up to 10 gallons of fluid for use by the cutter. These are preferably designed to allow "daisy chaining" to increase the capacity and cutting time of the system. The fluid is preferably contained in sealed sections that can be stacked one after the other in the assembly to cover the full range of casing sizes.

Preferably, next is a pump section 13. This preferably compresses the fluid to a specified pressure using a high-performance motor and pump.

Preferably following the pump section 13 is an accumulator section 14. This preferably allows the system to have continuous pressure while running with no drops or interruptions. The accumulator allows a greater volume of pressurized fluid to be provided to the cutting head, thus ensuring continuous performance.

Preferably a clamping section 15 follows. Hydraulically actuated arms extend from the tool body and clamp against the casing wall. This preferably both holds the tool in place in the well and centralizes the cutting head within the casing. Preferably, clamps have a leak down valve fitted to allow slow de-pressurization of the tool in the event of power failure, thus allowing a fail safe to withdraw the tool from the well bore.

Preferably a rotary section 16 follows. This is preferably programmable rotational control unit which will allow the lower sections to rotate through a minimum of 360 degrees. Also it may allow passthrough of fluid and electrical connections.

Preferably a cutting section 17 follows. In this preferred embodiment, the cutting section houses the cutting media in a hopper 21 above the cutting head. Preferably, the cutting head is indexable, as it is stored in a vertical-like position while lowering to depth and then indexed out to the horizontal position when the clamps have been engaged. Given the range of casing sizes preferably covered, it is not preferred to thrust the cutting head out to a horizontal position when the clamps have been engaged. Preferably, the cutting head is a design which orientates out the side of the tool into a pre-determined diameter and angle. In this preferred embodiment, media and high-pressure fluid are mixed in this section at a pre-determined ratio, this is then fed through the cutting head and nozzle. Preferably, in this embodiment the section rotates and cuts the casing wall, severing the pipework. A preferred cutting section includes a Terydon TCH-3 nozzle, but other nozzles may be employed as one of ordinary skill in the art would understand.

Preferably a lower centralizer 18 is used to centralize the cutting section from below. Also, this preferably contains a sensor to detect movement (slippage) and signal the wireline operator that the cut has been completed.

The invention claimed is:

1. A water jet cutting tool assembly comprising:

a top connection and an electronics section;

a first fluid containment section containing fluid for use by the water jet cutting tool assembly;

a pump section compressing the fluid in the first fluid containment section;

an accumulator section;

a rotary section; and a cutting section comprising a hopper to contain a cutting media;

wherein the top connection and the electronics section, the first fluid containment section, the pump section, the accumulator section, the rotary section and the cutting section are connected from top to bottom in sequence as listed and can be accommodated in a well casing, and wherein the accumulator section enable the water jet cutting tool assembly to have continuous pressure while running with no drops or interruptions.

2. The water jet cutting tool assembly of claim 1, wherein the first fluid containment section contains five to twenty gallons of fluid.

3. The water jet cutting tool assembly of claim 2, wherein the first fluid containment section contains about ten gallons of fluid.

4. The water jet cutting tool assembly of claim 3, further comprising a second fluid containment section connected at one end to the first fluid containment section and connected at another end to the pump section.

5. The water jet cutting tool assembly of claim 3, further comprising an additional section connected between two other sections.

6. The water jet cutting tool assembly of claim 2, further comprising a second fluid containment section connected at one end to the first fluid containment section and connected at another end to the pump section.

7. The water jet cutting tool assembly of claim 2, further comprising an additional section connected between two other sections.

8. The water jet cutting tool assembly of claim 1, further comprising a second fluid containment section connected at one end to the first fluid containment section and connected at another end to the pump section.

9. The water jet cutting tool assembly of claim 1, further comprising an additional section connected between two other sections.

* * * * *